US007677561B2

(12) United States Patent
Matsumoto et al.

(10) Patent No.: US 7,677,561 B2
(45) Date of Patent: Mar. 16, 2010

(54) TRANSPORT ROLLER, TRANSPORT MECHANISM, AND IMAGE FORMING APPARATUS

(75) Inventors: Yoshitaka Matsumoto, Osaka (JP); Masaru Tsuji, Nara (JP); Hidetoshi Kaneko, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 229 days.

(21) Appl. No.: 11/762,789

(22) Filed: Jun. 14, 2007

(65) Prior Publication Data

US 2007/0290435 A1 Dec. 20, 2007

(30) Foreign Application Priority Data

Jun. 19, 2006 (JP) ..... 2006-168958

(51) Int. Cl.
*B65H 5/02* (2006.01)
*B65H 29/20* (2006.01)

(52) U.S. Cl. ..... 271/272; 271/188; 271/314

(58) Field of Classification Search ..... 271/188, 271/209, 272, 314; 399/405, 407; 492/30, 492/28, 39

See application file for complete search history.

(56) References Cited

U.S. PATENT DOCUMENTS

| | | | | |
|---|---|---|---|---|
| 5,153,663 | A * | 10/1992 | Bober et al. | 399/406 |
| 6,089,567 | A * | 7/2000 | Yatsuhashi et al. | 271/314 |
| 6,626,427 | B2 * | 9/2003 | Choi et al. | 271/119 |
| 7,222,570 | B2 * | 5/2007 | Kawamura et al. | 101/477 |
| 2006/0163803 | A1 * | 7/2006 | Izuchi et al. | 271/272 |

FOREIGN PATENT DOCUMENTS

| | | |
|---|---|---|
| JP | 10-139251 | 5/1998 |
| JP | 11-065192 | 3/1999 |
| JP | 2006-232497 | 9/2006 |

* cited by examiner

*Primary Examiner*—David H Bollinger
(74) *Attorney, Agent, or Firm*—Renner, Otto, Boisselle & Sklar, LLP

(57) ABSTRACT

A transport roller is provided in a transport path in order to transport paper, the transport roller transporting the paper downstream in the transport path by making contact with the paper, and At least one contact portion that makes contact with the paper is provided in the transport roller. The contact portion is deformable in a direction that releases pressing force received from the paper when transporting the paper.

11 Claims, 5 Drawing Sheets

TRANSPORT ROLLER, TRANSPORT MECHANISM, AND IMAGE FORMING APPARATUS

This application claims priority under 35 U.S.C. §119(a) on Japanese Patent Application No. 2006-168958 filed in Japan on Jun. 19, 2006, the entire contents of which are hereby incorporated by reference.

BACKGROUND OF THE INVENTION

1. Field of the Invention

The present invention relates to a transport roller and a transport mechanism that are used in an image forming apparatus.

2. Description of the Related Art

Ordinarily, in electrophotographic image forming apparatuses such as copy machines, printers, and facsimile machines, a curling phenomenon ordinarily occurs in paper that has passed through a fixing portion that fixes developer on the paper.

This phenomenon is conceivable caused by a difference in temperature between a hot roller and a pressure roller in the fixing portion (amount of moisture evaporation at the paper surface). This temperature difference is produced for the following reasons. Generally, in order for the hot roller of the fixing portion to melt non-fixed developer on the paper to fix the developer to the paper, the hot roller has a heat source inside or near the outer circumferential face of the roller. On the other hand, the pressure roller is configured to receive heat from a contact portion that makes contact with the hot roller. Thus, the surface temperature of the hot roller is high (for example, 160 to 200° C.), while the surface temperature of the pressure roller is lower (for example, 110 to 150° C.), so that a temperature difference exists between the hot roller and the pressure roller.

More specifically, when paper having a constant moisture content receives a temperature history in the fixing portion after passing through a transfer process, a large amount of the moisture of the paper surface on the hot roller side evaporates, while a small amount of the moisture of the paper surface (paper back face) on the pressure roller side evaporates, so the amount of expansion or contraction of cellulose of the like constituting the paper is different for the front and back faces of the paper, and as a result, paper that has passed through the fixing portion is in a curled state.

Thus, when discharging paper curled in this manner onto a discharge tray using a discharge mechanism, there is a reduction in the stackability of the paper, and furthermore the paper is provided to a user in that curled state.

So, as conventional technology, discharge apparatuses have been disclosed that properly discharge paper with curling corrected (for example, see JP H11-65192A (hereinafter, referred to as "Patent Document 1")). In Patent Document 1, in a transport path that transports paper on which unfixed developer has been fixed by a fixing portion, a plurality of drive rollers, and idler rollers that form pairs with the drive rollers, are disposed in the transport direction, and by passing the paper through a nip portion between each of these drive rollers and idler rollers, paper that curled in the transport process is handled to correct its curling, and then that paper is discharged to a discharge tray.

According to the technology described in above Patent Document 1, the idler rollers that form pairs with the drive rollers press against the drive rollers with biasing force provided by respectively independent pressing means, thus correcting curling of stiff, thick paper.

However, with this technology, correction of curling of paper with a different thickness than thick paper such as standard paper or thin paper is performed with the same sort of pressing force. Thus, when using the technology described in above Patent Document 1, creases, tears, or other damage will occur in paper that is less stiff than thick paper.

SUMMARY OF THE INVENTION

In order to address the problems in the related art described above, it is an object of the present invention to provide a transport roller, transport mechanism, and image forming apparatus that, when transporting paper, correct curling of a desired paper without damaging the paper, regardless of the thickness or stiffness of the paper.

In order to attain the above object, the transport roller according to the invention is provided in a transport path in order to transport paper, the transport roller transporting the paper downstream in the transport path by making contact with the paper, the transport roller including at least one contact portion that makes contact with the paper, and is deformable in a direction that releases pressing force received from the paper when transporting the paper.

According to the invention, the contact portion that makes contact with the paper is provided, and when transporting the paper, the contact portion is deformable in a direction that releases pressing force received from the paper, so when transporting the paper, it is possible to correct curling of a desired paper without damaging the paper, regardless of the thickness or stiffness of the paper. That is, with the invention, it is possible to vary the amount of deformation in the direction that releases pressing force received from the paper when transporting the paper, and as a result, it is possible to deform the contact portion according to the thickness or stiffness of the paper.

In the above configuration, contact portions may be provided at a plurality of points, with at least one of the contact portions being deformable.

In this case, contact portions are provided at a plurality of points, with at least one of the contact portions being deformable, so the pressing force received from the paper can be dispersed among the contact portions at a plurality of points. Thus, the pressing force applied to individual contact portions can be suppressed, so that not only does it become possible to correct curling of a desired paper without damaging the paper, regardless of the thickness or stiffness of the paper, it is also possible to perform paper transport while maintaining a transport force that is appropriate to the thickness and stiffness of the paper. As a result, the pressing force received from the paper is dispersed by increasing the contact points, so that it becomes possible to transport any paper with a maximum amount of transport force, and moreover, it becomes possible to suppress the occurrence of creases or other damage in comparison to a configuration with one contact point.

In the above configuration, a hollow portion may be formed near the contact portion in the body of the transport roller.

In this case, a hollow portion is formed near the contact portion in the body of the transport roller, so the hollow portion can be used as a part that releases the pressing force received when transporting the paper.

In the above configuration, a protruding portion with a bent tip may be formed, the tip of the protruding portion being the contact portion.

In this case, a protruding portion with a bent tip is formed, the tip of the protruding portion being the contact portion, so it is possible to insure that the tip vicinity is a part that releases the pressing force received when transporting the paper.

In order to attain the above object, in the transport mechanism according to the invention, a plurality of the transport rollers according to the invention described above are provided to one shaft, the plurality of transport rollers transporting paper downstream in the transport path by making contact with the paper.

According to the invention, a plurality of the transport rollers according to the invention described above are provided to one shaft, and the plurality of transport rollers are capable of correcting curling of an entire sheet of paper transported downstream in the transport path by making contact with the paper.

In the above configuration, the transport mechanism may be configured from the transport rollers, that drivingly rotate, and idler rollers that make contact with the transport rollers and idly rotate due to the driving rotation of the transport rollers, with the paper transported to a nip portion, which is a contact region between the transport rollers and the idler rollers, and transported downstream in the transport path by the driving rotation of the transport rollers and the idling rotation of the idler rollers.

In this case, the transport mechanism is be configured from the above-described transport rollers and idler rollers, with the paper transported to a nip portion, and transported downstream in the transport path by the driving rotation of the transport rollers and the idling rotation of the idler rollers, so it is possible to transport paper with a nip force appropriate to the thickness and stiffness of the paper. More specifically, for any paper it is possible to transport that paper with a minimum of nip force, and as a result, it is possible to obtain a maximum of paper transport force. Also, because it is possible to transport the paper with a minimum of nip force, it is possible to attain a longer operating life for the transport rollers and the idler rollers.

In the above configuration, the amount of deformation of the contact portion may differ for each of the plurality of transport rollers for the one shaft, with the amount of deformation of the contact portion is set to become smaller from, of the plurality of transport rollers, a transport roller disposed at an end of the shaft toward a transport roller disposed in the center of the shaft.

In this case, the amount of deformation of the contact portion differs for each of the plurality of transport rollers for the one shaft, with the amount of deformation of the contact portion is set to become smaller from, of the plurality of transport rollers, a transport roller disposed at an end of the shaft toward a transport roller disposed in the center of the shaft, so rather than correcting paper curling at each of the plurality of transport rollers, it is possible to correct curling of an entire sheet of paper with the plurality of transport rollers for the one shaft.

In order to attain the above object, in the image forming apparatus according to the invention, the transport mechanism according to the invention is provided downstream in the transport path from a fixing portion that fixes developer to the paper.

According to the invention, the transport mechanism according to the invention described above is provided downstream in the transport path from the fixing portion, so it is particularly possible to have an effect of correcting curling that occurs in paper that has passed through the fixing portion. For example, when the transport mechanism according to the invention has been provided in the discharge stage of the transport path after fixing of developer to the paper, it is possible to improve the stackability of the discharged paper. Also, when a switchback transport path is provided in order to allow duplex printing (transfer of developer to both faces of the paper) in the image forming apparatus, and the transport mechanism according to the invention has been provided in the switchback transport path, it is possible to suppress paper transport jams. Further, with the conventional technology, the paper is curled, so there may be cases in which when performing duplex printing, the face on which developer has already been fixed attaches to an intermediate transfer belt, a transfer roller, or the like, but according to the invention the paper is not curled, so transfer efficiency and transport efficiency can be improved.

In the above configuration, a paper post-processing portion may be added to or provided in the image forming apparatus, the paper post-processing portion performing paper post-processing for paper on which developer has been fixed, with the transport mechanism being provided in the paper post-processing portion.

In this case, a paper post-processing portion is be added to or provided in the image forming apparatus, the paper post-processing portion performing paper post-processing for paper on which developer has been fixed, with the transport mechanism being provided in the paper post-processing portion, so it is possible to improve stackability when performing paper post-processing in the paper post-processing portion.

In the above configuration, the transport mechanism may be provided furthest downstream in the transport path and inside the body of the image forming apparatus.

In this case, the transport mechanism is provided furthest downstream in the transport path and inside the body of the image forming apparatus, so it is possible to correct paper curling immediately before discharging paper to a discharge portion of the image forming apparatus such as a discharge tray or the like. As a result, it is possible to improve the stackability of the discharged paper.

In the above configuration, a plurality of the transport mechanisms are provided in the transport path.

In this case, a plurality of the transport mechanisms are provided in the transport path, and such a configuration is preferable for correcting paper curling.

In the above configuration, in the plurality of transport mechanisms, the amount of deformation of the contact portion may be set to become smaller from a transport mechanism disposed upstream in the transport path toward a transport mechanism disposed downstream in the transport path.

In this case, in the plurality of transport mechanisms, the amount of deformation of the contact portion is be set to become smaller from a transport mechanism disposed upstream in the transport path toward a transport mechanism disposed downstream in the transport path, so it is possible to by gradually correcting paper curling of the paper, for any paper it is possible to transport that paper with a minimum of nip force at each of the plurality of transport mechanisms, and as a result, it is possible to obtain a maximum of paper transport force for the image forming apparatus.

DESCRIPTION OF THE PREFERRED EMBODIMENTS

Hereinafter, embodiments of the present invention will be described in detail with reference to the accompanying drawings.

In this embodiment, a case will be described in which the invention is applied to a compound machine (image forming apparatus) provided with a copy function, a print function, and a facsimile function.

Overall Configuration of Image Forming Apparatus

Figure 1:
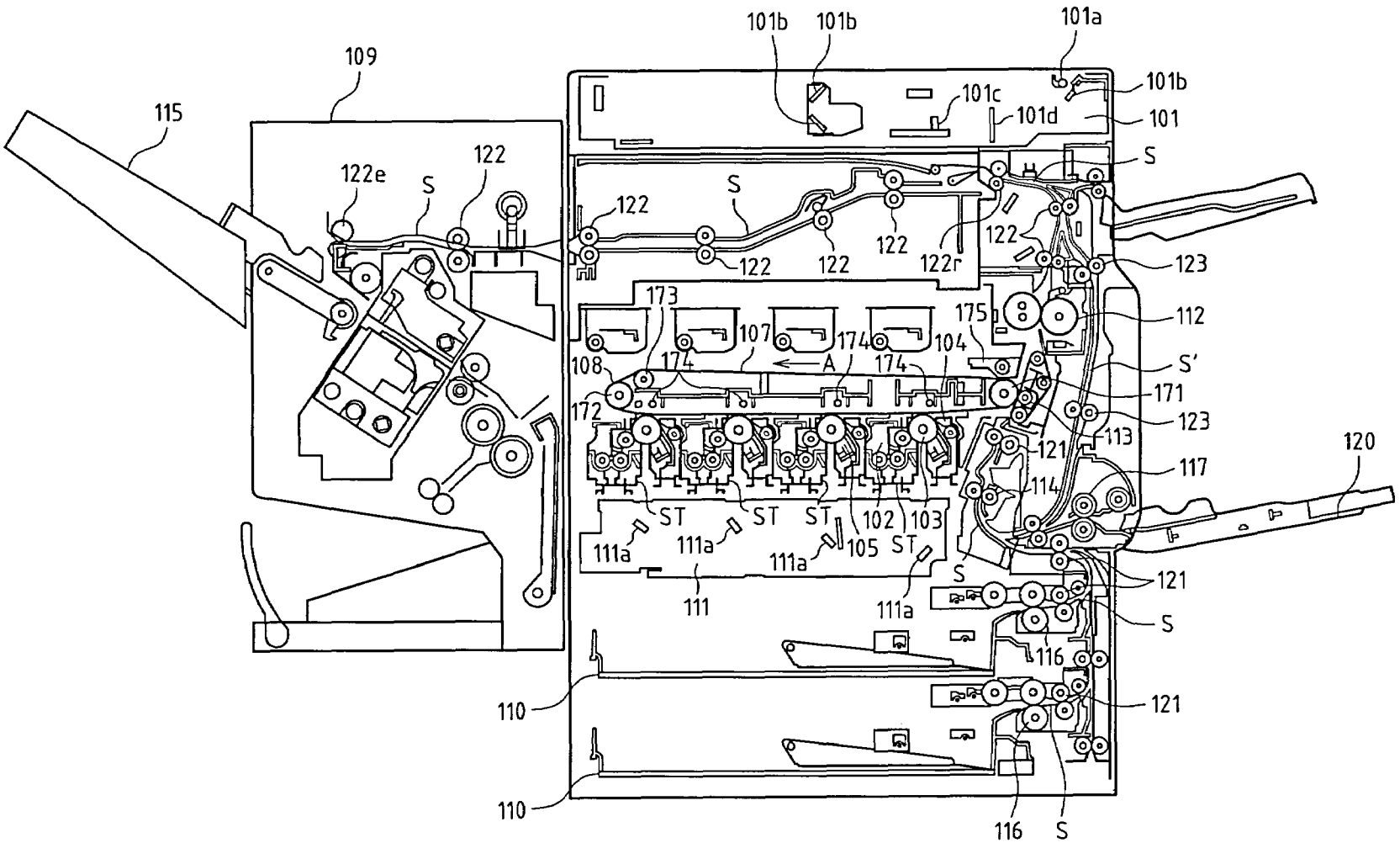
FIG. 1 shows the overall configuration of a color tandem-type image forming apparatus with a paper post-processing portion added, according to an embodiment of the invention.

As shown in FIG. 1, an image forming apparatus 100 is provided with an image capturing system, an image forming system, and a paper transport system. Each is described below.

Image Capturing System

A scanner portion 101 creates original image data by capturing an image of an original placed on an original stage (not shown) configured using a transparent glass or the like or an image of originals supplied one by one by an unshown auto document feeder. The scanner portion 101 is provided with an exposing light source 101*a*, a plurality of reflecting mirrors 101*b*, an imaging lens 101*c*, and a photoelectric transducer (CCD: Charge Couple Device) 101*d*.

The exposing light source 101*a* irradiates light to an original placed on the original stage or an original transported through the auto document feeder. The reflecting mirrors 101*b* reflect reflected light from the original, and reflect the light from the exposing light source 101*a* toward the imaging lens 101*c*. As an original image capturing operation, when an original has been placed on the original stage (usage as a "sheet-fixing type"), the exposing light source 101*a* and the reflecting mirrors 101*b* scan in the horizontal direction along the original stage to capture an image of the entire original. On the other hand, when capturing an original transported through the auto document feeder (usage as "sheet moving-type"), the exposing light source 101*a* and the reflecting mirrors 101*b* are fixed at positions that have been set in advance, and when the original passes through an original capturing portion of the auto document feeder, an image of that original is captured. Light that has been reflected by the reflecting mirrors 101*b* and passed through the imaging lens 101*c* is guided to the CCD 101*d*, and in the CCD 101*d* the reflected light is converted into an electrical signal (original image data).

Image Forming System and Paper Transport System

As shown in FIG. 1, the image forming apparatus 100 is a color tandem-type image forming apparatus that, in response to original image data that has been transmitted from outside, forms color and monochrome images on paper (a sheet). The image forming apparatus 100 is configured with a development unit 102, a photosensitive drum 103 (electrostatic latent image carrier), a cleaning unit 104, a charging unit 105, an intermediate transfer belt 107, an intermediate transfer belt unit 108, a paper post-processing portion 109 (a discharge tray 115), supply trays 110, an exposing unit 111, a fixing unit 112, transport paths S and S', and the like.

The original image data handled in the image forming apparatus 100 corresponds to a color image using the colors black (K), cyan (C), magenta (M), and yellow (Y). Accordingly, as shown in FIG. 1, so as to form four types of latent images corresponding to the colors (K, C, M, Y), four each of the development unit 102, the photosensitive drum 103, the cleaning unit 104, and the charging unit 105 are provided, so that four image stations ST (image forming portions) corresponding to the colors (K, C, M, Y) are configured.

The image forming apparatus 100 is configured as a color image forming apparatus employing an intermediate transfer method in which, as described below, after image information that has been color-separated into a plurality of colors (four colors in this example) is, using a plurality of the photosensitive drums 103 (four in this example), transferred in layers to the intermediate transfer belt 107, which rotates in contact with each of the photosensitive drums 103 at a predetermined pressure, a color image is formed on paper by transferring that image information all at once onto paper transported from a paper storage portion such as the supply trays 110.

The photosensitive drums 103 are disposed inside the image forming apparatus 100. Disposed around the circumference of each photosensitive drum 103 is a development unit 102, a cleaning unit 104, a charging unit 105, and the like.

With toner of the colors (K, C, M, Y), the development unit 102 makes visible the electrostatic latent image formed on each photosensitive drum 103, thus forming a toner image of each color.

The cleaning unit 104 removes and recovers toner remaining on the surface of the photosensitive drum 103 after development and image transfer.

The charging unit 105 is a charging means for charging the surface of the photosensitive drum 103 to a predetermined potential. In this example, a contact roller-type charging unit is used. A brush-type charging unit or a charger-type charging unit may also be used.

The exposing unit 111 has a function to, by exposing the photosensitive drums 103 that have been charged by the charging unit 105 according to input image data, form an electrostatic latent image corresponding to the image data on the surface of the photosensitive drums 103. A laser scanning unit (LSU) provided with a laser irradiating portion and a reflecting mirror 111*a* and the like is used as the exposing unit 111. An EL or LED write head in which emitting elements are aligned in an array may for example also be used as the exposing unit 111.

The intermediate transfer belt unit 108 forms a color image or monochrome image on paper using an intermediate transfer method, and is provided with the intermediate transfer belt 107, an intermediate transfer belt drive roller 171, an intermediate transfer belt idler roller 172, an intermediate transfer belt tension mechanism 173, intermediate transfer rollers 174, and an intermediate transfer belt cleaning unit 175.

The intermediate transfer rollers 174 are rotatably supported by an intermediate transfer roller installation portion (not shown) of the intermediate transfer belt tension mechanism 173 of the transfer belt unit 108, and provide a transfer bias for transferring the toner image on the photosensitive drum 103 onto the intermediate transfer belt 107.

The intermediate transfer belt 107 is stretched across the intermediate transfer belt drive roller 171, the intermediate transfer belt idler roller 172, an intermediate transfer belt tension roller of the intermediate transfer belt tension mechanism 173, the intermediate transfer rollers 174, and the like, and is rotatably driven in the direction of arrow A. The intermediate transfer belt 107 is provided so as to make contact with (be sandwiched by) the respective photosensitive drums 103, and by transferring, sequentially layered, the toner images of each color formed on each of the photosensitive drums 103 to the intermediate transfer belt 107, a color toner image (multicolor or single color image) is formed on the intermediate transfer belt 107. The intermediate transfer belt 107 is formed to be endless using a film with a thickness of about 100 to 150 mm.

The transfer of a toner image from the photosensitive drums 103 to the intermediate transfer belt 107 is performed by the intermediate transfer rollers 174, which make contact with the back side of the intermediate transfer belt 107. A high voltage transfer bias (a high voltage with a polarity (+) opposite to the charging polarity (−) of the toner) is applied to the intermediate transfer rollers 174 in order to transfer the toner image.

The intermediate transfer rollers 174 use a metal shaft (for example, stainless steel) with a diameter of 8 to 10 mm as a base, with the surface of that shaft being covered with electrically conductive elastic material (for example, such as EPDM or urethane foam). With this electrically conductive elastic material, it is possible to uniformly apply a high voltage to the intermediate transfer belt 107. In this example, the intermediate transfer rollers 174 are used as transfer electrodes, but a brush or the like may by used instead.

In the above manner, latent images that have been made visible on the photosensitive drums 103 corresponding to each color are layered on the intermediate transfer belt 107, and become the image information input to the apparatus. The image information layered in this manner is, due to rotation of the intermediate transfer belt 107, transferred onto paper by a transfer roller 113 disposed at a contact position of the paper and the intermediate transfer belt 107, described later.

At this time, the intermediate transfer belt 107 and the transfer roller 113 are pressed against with a predetermined nip, and a voltage for transferring toner to the paper is applied to the transfer roller 113 (a high voltage with a polarity (+) opposite to the charging polarity (−) of the toner). Further, in order for the transfer roller 113 to constantly obtain that nip, it is preferable that a hard material (such as metal) is used for either the transfer roller 113 or the intermediate transfer belt drive roller 171, and for the other, a soft material such as an elastic roller or the like (for example, such as an elastic rubber roller or a foam resin roller) is used.

Also, as stated above, toner affixed to the intermediate transfer belt 107 due to contact with the photosensitive drums 103, or toner remaining on the intermediate transfer belt 107 without being transferred onto the paper by the transfer roller 113, will cause mixing of toner colors in the next step, so a configuration is provided in which such toner is removed and recovered by the intermediate transfer belt cleaning unit 175.

A member that makes contact with the intermediate transfer belt 107, for example a cleaning blade provided as a cleaning member, is provided in the intermediate transfer belt cleaning unit 175, and the intermediate transfer belt 107, contacted by that cleaning blade, is supported by the intermediate transfer belt drive roller 171 from the back side.

The supply trays 110 are for storing paper (recording sheets) used for image forming, and two of the supply trays 110 are provided in the lower portion of the image forming apparatus 100. Also, paper for which printing is finished is placed in the discharge tray 115 provided in the paper post-processing portion 109 added to the image forming apparatus 100. Further, a manual feed tray 120 is provided in the body of the image forming apparatus 100, and by using the manual feed tray 120 it is not necessary to perform an operation of opening or closing the supply trays 110. The manual feed tray 120 supplies paper by feeding the paper to the transport path S page by page using a pickup disposed at the end of the manual feed tray 120.

The transport path S is provided in the image forming apparatus 100 in order to feed paper of the supply trays 110 to the discharge tray 115 by way of the transfer roller 113 and the fixing unit 112. Also, the switchback transport path S' is provided in the image forming apparatus 100 so that duplex printing (transfer of developer to both faces of the paper) is possible. Near the transport path S from the supply trays 110 to the discharge tray 115, and the switchback transport path S' for allowing duplex printing, are provided the fixing unit 112, the transfer roller 113, a registration roller 114, pickup rollers (paper transport rollers) 116 and 117, and transport mechanisms 121 to 123 that transport the paper.

The fixing unit 112 (fixing portion) is provided with a hot roller, a pressure roller, and the like. The hot roller and the pressure roller rotate while sandwiching the paper.

Also, the hot roller is set to a predetermined fixing temperature by a control based on a signal from a temperature detector that is not shown, and the hot roller, by applying heat and pressure to the paper, melts, mixes, and applies pressure to the multicolor toner image transferred to the paper, thus fixing the image with heat and pressure. After the multicolor toner image has been fixed, the paper is transported to the transport path S by transport rollers 122, and in a reversed state (with the multicolor/single color toner image pointed downstream), the paper is discharged onto the discharge tray 115.

The pickup rollers 116 are provided at the end of the supply trays 110. The pickup rollers 116 supply paper page by page to the transport path S. The registration roller 114 temporarily holds the paper transported through the transport path S, and transports the paper to the transfer roller 113 at a timing that matches the leading edge of the toner image on the intermediate transfer belt 107 to the leading edge of the paper.

The transport mechanisms 121 to 123 are small rollers used in order to promote and assist paper transport, and a plurality of the transport mechanisms 121 to 123 are provided along the transport paths S and S'. Specifically, the transport mechanisms 121 are provided on the transport upstream side of the fixing unit 112, the transport mechanisms 122 are provided on the transport downstream side of the fixing unit 112, and the transport mechanisms 123 are provided in the switchback transport path S'.

Added to the image forming apparatus 100 having the characteristics described above is the paper post-processing portion 109, which performs paper post-processing for paper on which developer has been fixed (printing has been performed) in the fixing unit 112. The functions of the paper post-processing portion 109 include, for example, a stapling function, a hole-punching function, and a binding function. Also, the transport path S is provided in the paper post-processing portion 109, formed continuous from the body of the image forming apparatus 100, and the plurality of transport mechanisms 122 are provided in the transport path S. Of these transport mechanisms 122, the transport mechanism according to the invention is applied to a transport mechanism 122*e* immediately before the discharge tray 115.

Figure 2A:
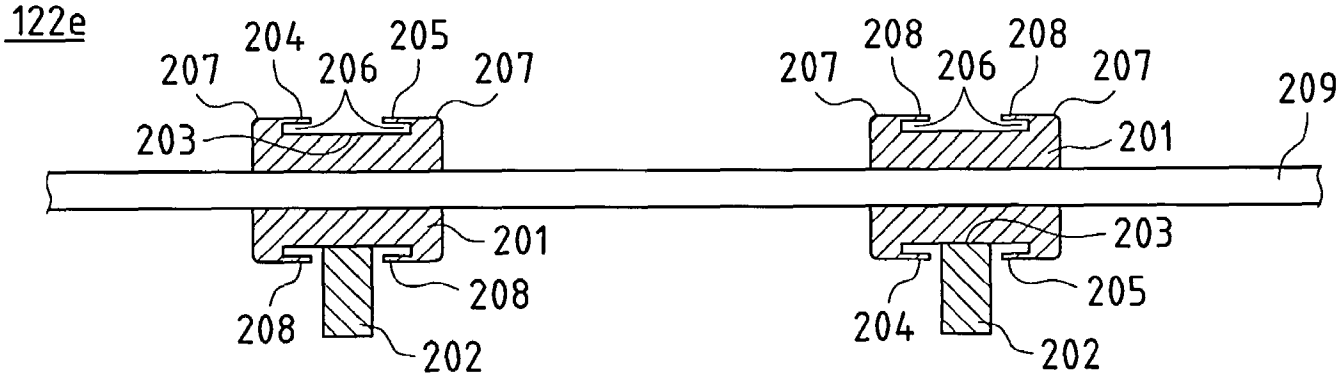
FIG. 2A shows the overall configuration of a transport roller according to an embodiment of the invention.
Figure 2B:
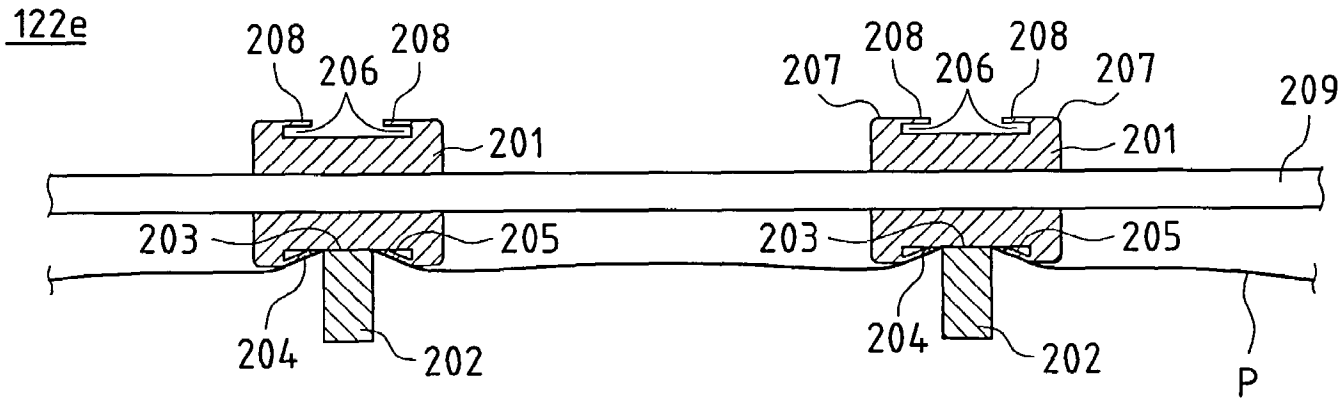
FIG. 2B shows the overall configuration of the transport roller when paper is being transported, according to an embodiment of the invention.

The transport mechanism 122*e* makes contact with the paper to transport the paper downstream in the transport path, and as shown in FIG. 2 (FIG. 2A and FIG. 2B), is configured from five transport rollers 201 that drivingly rotate, and five idler rollers 202 that make contact with the transport rollers 201 and idly rotate due to the driving rotation of the transport rollers 201. In FIG. 2, two of the transport rollers 201 and two of the idler rollers 202 are shown.

In the transport mechanism 122*e*, the five transport rollers 201 are provided on one shaft 209 in the direction perpendicular to the transport direction of the paper, and the five idler rollers 202 that form pairs with the transport rollers 201 are provided on one idler shaft (not shown). Thus, the transport rollers 201 and the idler rollers 202 that form five pairs, each with the same operation, make contact with the paper and transport the paper downstream in the transport path. That is, as shown in FIG. 2B, when the paper is transported to a nip portion, which is a contact region between a transport roller 201 and an idler roller 202, the paper is transported downstream in the transport path by the driving rotation of the transport roller 201 and the idling rotation of the idler roller 202.

The transport rollers 201 are configured with a side face of their cylindrical body perpendicular to the vertical direction, and the shaft 209 piercing through the transport rollers 201 from the upper face to the lower face. In the side face portion of the body of the transport rollers 201, contact portions 203 to 205 are provided that make contact with the paper. Also, a hollow portion 206 is formed in the vicinity of the contact portions 203 to 205. The contact portions 203 to 205 are provided at three points, and of those, two of the contact portions 204 and 205 are deformable in the direction that releases pressing force received from the paper when transporting the paper. The amount of deformation of the contact portions 204 and 205 of the five transport rollers 201 on the single shaft 209 is the same for all of the contact portions.

Incidentally, in the transport rollers 201, around the entire circumference of the end face portion of the body of the transport rollers 201, two protruding portions 207 are formed that protrude in the direction perpendicular to the axis direction of the shaft 209, at the top face side and the bottom face side of the side face portion, and tips 208 of these protruding portions 207 are respectively bent so as to face each other. These tips 208 of the protruding portions 207 are used as the two contact portions 204 and 205. Also, due to the bent formation of the tips 208 of the protruding portions 207, the hollow portion 206 is formed in the vicinity of the contact portions 204 and 205. The one remaining contact portion 203 is provided in the center of the side face portion that faces the hollow portion 206, and this contact portion 203 is used as the nip portion, which is the contact region of the transport roller 201 and the idler roller 202.

In the transport mechanism 122*e* described above, when the paper is transported, there is a change from the state shown in FIG. 2A to the state shown in FIG. 2B. More specifically, when the paper is transported by the transport mechanism 122*e*, with the paper P in a state contacting the contact portion 203, which is the nip portion, and the contact portions 204 and 205 of the tips 208 of the protruding portions 207 as shown in FIG. 2B, the paper P is transported by the nip portion to the discharge tray 115 downstream in the transport path, due to the driving rotation of the transport roller 201 and the idling rotation of the idler roller 202. At this time, the contact portions 204 and 205 of the tips 208 of the protruding portions 207 are deformed in the direction that releases the pressing force received from the paper P when transporting the paper P (the direction upward from the paper face in FIG. 2B), and when transport of the paper P by the transport mechanism 122*e* is finished, the contact portions 204 and 205 are in the non-deformed state shown in FIG. 2A.

Next is a detailed description of the paper transport paths of the above image forming apparatus 100, with reference to FIG. 1.

First, disposed in the image forming apparatus 100 of this example are the supply trays 110, where paper is stored in advance, and the manual feed tray 120, whereby when the user prints a small number of sheets, it is not necessary to perform an operation of opening or closing the supply trays 110. The supply trays 110 and the manual feed tray 120 feed paper to the transport path page by page, the pickup rollers 116 and 117 respectively disposed at the end of the trays 110 and 120.

The paper transported from the paper tray 110 is transported to the registration roller 114 by the transport mechanism 121 in the transport path S, then transported to the transfer roller 113 at a timing that coordinates the leading edge of the paper with the leading edge of the image information on the intermediate transfer belt, and the image information is written onto the paper. Afterward, by passing through the fixing unit 112, unfixed toner on the paper is melted and fixed with heat, and then the paper travels through the transport path S and is discharged onto the discharge tray 115 by a discharge roller, which is the final transport mechanism 122*e* (in the case of a request for one-sided printing).

On the other hand, paper that has been stacked in the manual feed tray 120 is supplied by the pickup roller 117, reaches the registration rollers 114 via the plurality of transport mechanisms 121, and then is discharged to the discharge tray 115 via the same path as paper supplied from the supply trays 110 (in the case of a request for one-sided printing).

Here, when the content of the print request is a request for duplex printing, after one-sided printing in the above manner has been completed, the trailing edge of paper that has passed through the fixing unit 112 is chucked by a reverse roller 122*r* among the transport mechanisms 122, and in this state the reverse roller 122*r* rotates in reverse and thus the paper is guided into the reverse transport path S'. In the reverse transport path S', after being transported by the transport mechanism 123, the paper is again guided into the transport path S. Then, after printing has been performed on the rear face via the registration roller 114, the paper is discharged by the transport mechanism 121 to the discharge tray 115.

In the embodiment described above, there are contact portions at three points, but the invention is not limited to such a configuration; there may be contact portions at a plurality of points, with at least one of the contact portions being deformable.

Figure 3:
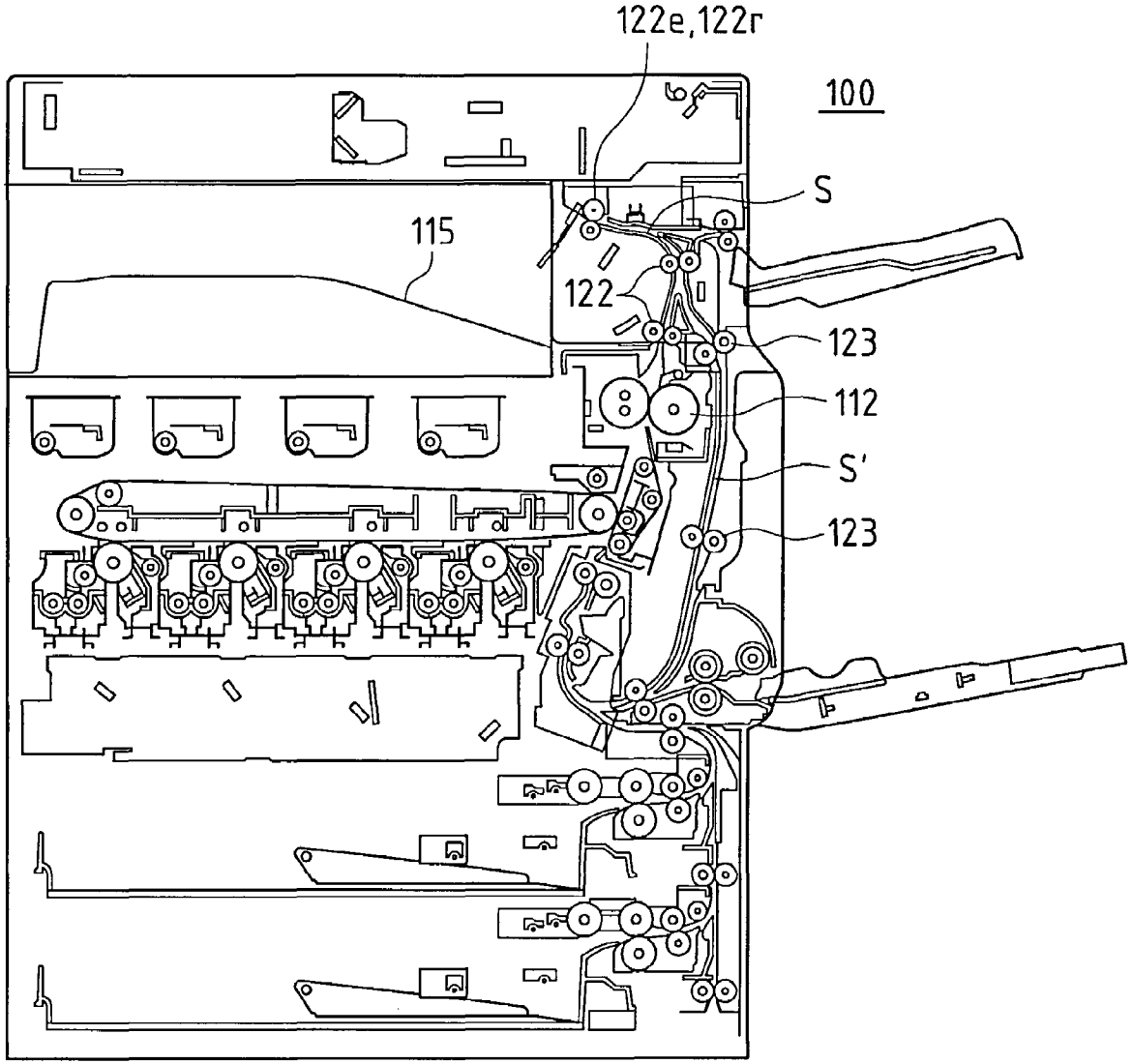
FIG. 3 shows the overall configuration of a color tandem-type image forming apparatus according to another embodiment of the invention.

Also, in this embodiment, the paper post-processing portion 109 was added to the image forming apparatus 100, but the invention is not limited to such a configuration; for example, it is possible that the paper post-processing portion 109 is not added, as shown in FIG. 3. At this time, as shown in FIG. 3, the transport mechanism 122*e* according to the invention is applied to the final transport mechanism inside the body of the image forming apparatus 100. In the image forming apparatus 100 shown in FIG. 3, because the paper post-processing portion 109 is not used, the discharge tray 115 is provided in the body of the image forming apparatus 100. Thus, in the image forming apparatus 100 shown in FIG. 3, the reverse roller 122*r* shown in FIG. 1 becomes the final transport mechanism (the transport mechanism provided furthest downstream in the transport path S), the reverse roller 122*r* is applied as the final transport mechanism 122*e*. In this case, the transport mechanism 122*e* is provided furthest downstream in the transport path S and inside the body of the image forming apparatus 100, so it is possible to correct curling of the paper immediately before discharging the paper to the discharge tray 115 of the image forming apparatus 100. As a result, it is possible to improve the stackability of the discharged paper.

Figure 4:
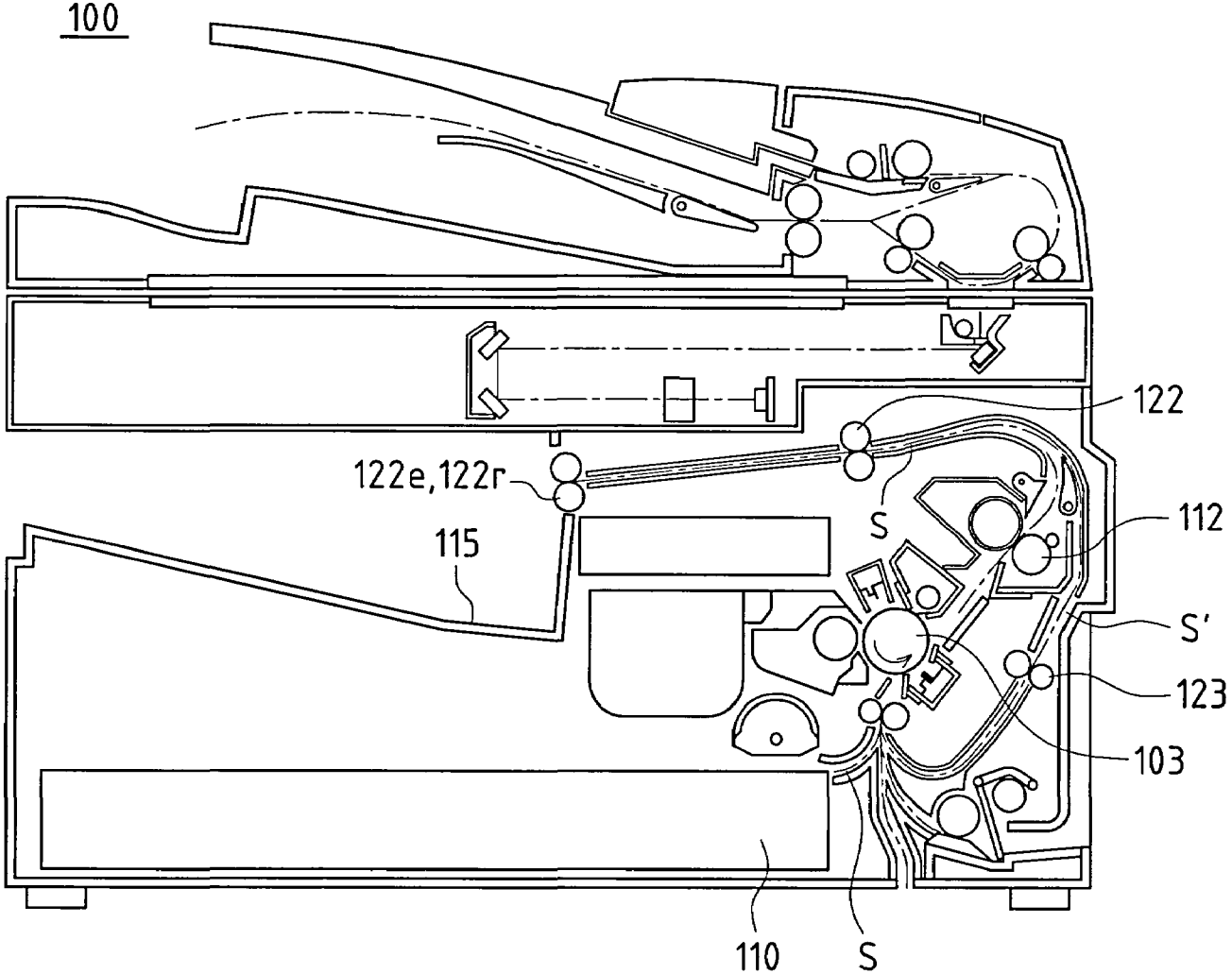
FIG. 4 shows the overall configuration of an image forming apparatus according to another embodiment of the invention.

Also, in this embodiment, a color tandem-type image forming apparatus that forms multicolor and single color images on paper is used, but the invention is not limited to such a configuration; for example, as shown in FIG. 4, the image forming apparatus 100 may also be configured from a single photosensitive drum 103. In the case of the image forming apparatus 100 shown in FIG. 4, the transport mechanism 122*e* according to the invention is adopted as the final transport mechanism, same as the transport mechanism 122 of the image forming apparatus shown in FIG. 3. In the image forming apparatus 100 shown in FIG. 4, only the general configuration of the image forming system (presence or absence of an intermediate transfer method) differs from that of the image forming apparatus 100 shown in FIGS. 1 and 3; the general configuration of the paper transport system (the paper transport path) according to the invention is the same. Thus, in this embodiment, a detailed description of the image forming system and the paper transport system that are shown in FIG. 4 is omitted.

Also, in this embodiment, as shown in FIGS. 1, 3, and 4, the transport mechanism 122*e* according to the invention is adopted as the final transport mechanism, but the invention is not limited to such a configuration; the transport mechanism 122*e* according to the invention may be adopted as another transport mechanism 122 in the transport path S that is downstream in the transport path from the fixing unit 112, or as a transport mechanism 123 in the switchback transport path S', and a plurality of the transport mechanisms 122*e* according to the invention may be used. In this case, by providing a plurality of the transport mechanisms 122*e* in the transport path S, it is possible to correct curling of respective papers with the plurality of transport mechanisms 122*e*, and thus, this configuration is preferable for correcting paper curling.

Also, in the embodiments shown in FIGS. 1, 3, and 4, one transport mechanism 122*e* is used, but as described above, a plurality of the transport mechanisms 122*e* may be used. At this time, in the plurality of transport mechanisms 122*e*, the amount of deformation of the contact portions 204 and 205 is to become smaller from a transport mechanism provided upstream in the transport path to a transport mechanism provided downstream. For example, the amount of deformation of the contact portions 204 and 205 may be varied by varying the protrusion length of the protruding portions 207. Alternatively, the amount of deformation of the contact portions 204 and 205 may be varied by varying the thickness of the tips 208 of the protruding portions 207. Alternatively, the amount of deformation of the contact portions 204 and 205 may be varied by using a plurality of materials of differing hardness for the materials of the respective protruding portions 207. In these cases, by gradually correcting curling of the paper, for any paper it is possible to transport that paper with a minimum of nip force at each of the plurality of transport mechanisms 122*e*, and as a result, it is possible to obtain a maximum of paper transport force for the image forming apparatus 100.

Also, in this embodiment, five of the transport rollers 201 are provided for one shaft 209, but the invention is not limited to such a configuration; the number of transport rollers 201 may be set as desired. It is preferable to provide a plurality of the transport rollers 201 for one shaft 209.

Also, in this embodiment, the amount of deformation is the same for all of the contact portions 204 and 205 of the plurality of transport rollers 201 for one shaft 209, but the invention is not limited to such a configuration; the amount of deformation may differ between respective contact portions 204 and 205 of the plurality of transport rollers 201 for one shaft 209, and in the transport mechanism 122*e*, the amount of deformation of the contact portions 204 and 205 may be set so as to become smaller from, of the plurality of transport rollers 201, a transport roller 201 disposed at an end of the shaft 209 toward a transport roller 201 disposed in the center of the shaft 209. For example, the amount of deformation of the contact portions 204 and 205 may be varied by varying the protrusion length of the protruding portions 207 such that the amount of deformation of the contact portions 204 and 205 becomes smaller from a transport roller 201 disposed at an end of the shaft 209 toward a transport roller 201 disposed in the center of the shaft 209. Alternatively, the amount of deformation of the contact portions 204 and 205 may be varied by varying the thickness of the tips 208 of the protruding portions 207. Alternatively, the amount of deformation of the contact portions 204 and 205 may be varied by using a plurality of materials of differing hardness for the materials of the respective protruding portions 207. In these cases, paper curling is not corrected at each of the plurality of transport rollers 201; rather, it is possible to correct curling of an entire sheet of paper as a single target with the plurality of transport rollers 201 for the one shaft 209. As a result, it is possible to prevent wrinkles in the center of the paper, tears at the ends of the paper, or the like that occur when the paper is transported by the transport mechanism 122*e*. An embodiment of this configuration is shown in FIG. 5.

Figure 5:
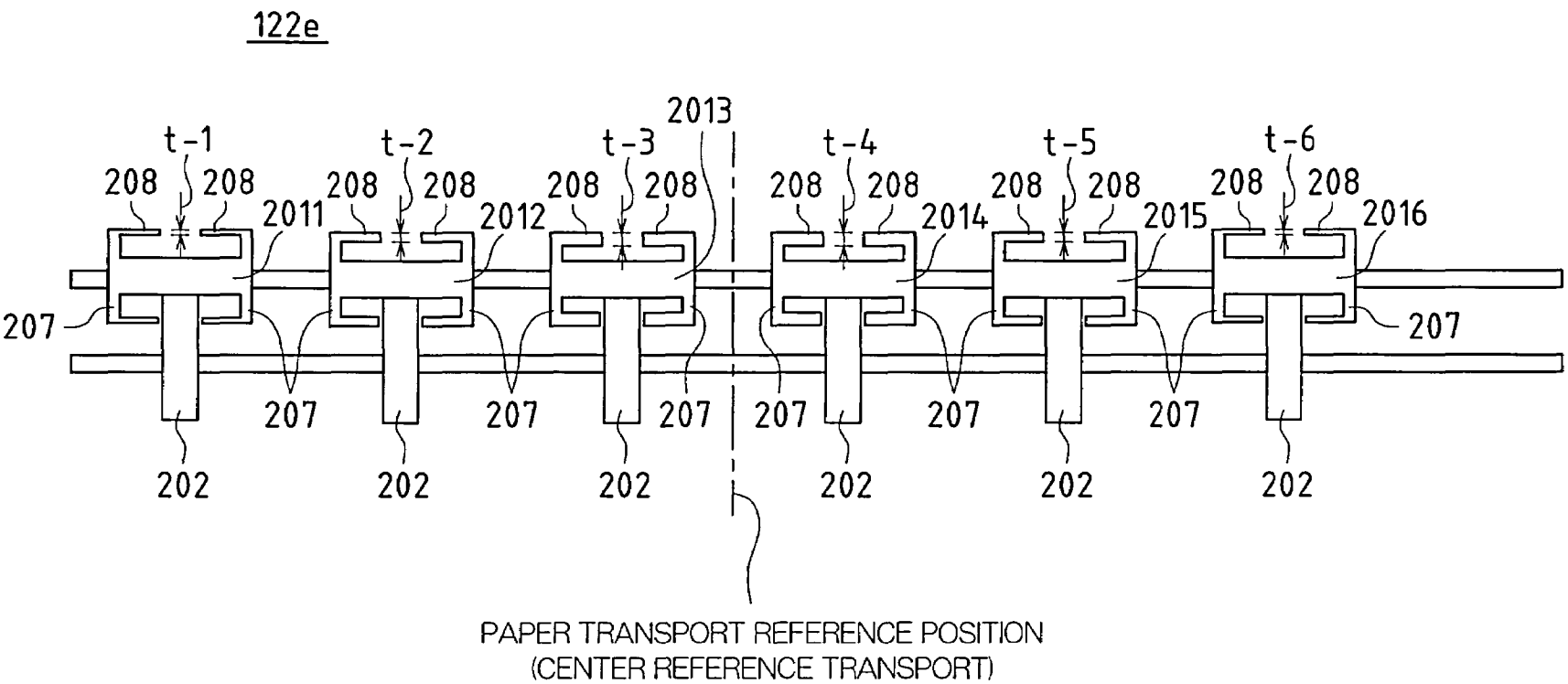
FIG. 5 shows the overall configuration of a transport roller according to another embodiment of the invention.

In the transport mechanism 122*e* of the embodiment shown in FIG. 5, only the number of transport rollers 201 for one shaft 209 and the thickness of the tips 208 of the protruding portions 207 of each transport roller 201 differ from the transport mechanism 122*e* shown in FIGS. 1 to 4; other contents of the configuration are the same. Thus, here, the number of transport rollers 201 and the thickness of the tips 208 of the protruding portions 207 are described, and a description of other contents of the configuration is omitted.

In the transport mechanism 122*e* shown in FIG. 5, six transport rollers 2011 to 2016 are provided for one shaft 209. In the six transport rollers 2011 to 2016, thicknesses t-1 to t-6 (corresponding to the last reference numeral of each of the transport rollers 2011 to 2016) of the tips 208 of the respective protruding portions 207 are set so as to become thicker from the transport rollers 2011 and 2016 disposed at the ends of the shaft 209 toward the transport rollers 2013 and 2014 respectively disposed near the center of the shaft 209 (paper transport reference position shown by dotted-chained line in FIG. 5), via the transport rollers 2012 and 2015. The thicknesses of the six transport rollers 2011 to 2016 are obtained from the relationships of the following expression.

$$(t\text{-}1)=(t\text{-}6)>(t\text{-}2)=(t\text{-}5)>(t\text{-}3)=(t\text{-}4) \qquad \text{Formula 1}$$

From the above configuration, in the transport mechanism 122*e* shown in FIG. 5, the thickness of the tips 208 of the protruding portions 207 of the transport rollers 2011 and 2016 disposed at the ends of the shaft 209 is made small and the amount of deformation made large, and the thickness of the tips 208 of the protruding portions 207 of the transport rollers 2013 and 2014 disposed near the center of the shaft 209 is made large and the amount of deformation made small. As a result, it is possible to correct curling of an entire sheet of paper as a single target with the plurality of transport rollers 201 of one shaft 209, and thus it is possible to prevent wrinkles in the center of the paper, tears at the ends of the paper, or the like that occur when the paper is transported by the transport mechanism 122*e*.

As described above, with the transport rollers 201, the contact portions 204 and 205 that make contact with the paper are provided, and the contact portions 204 and 205 are deformable in the direction that releases pressing force received from the paper when the paper is transported, so when transporting the paper, it is possible to correct curling of a desired paper without damaging the paper, regardless of the thickness or stiffness of the paper. More specifically, it is possible to vary the amount of deformation in the direction that releases pressing force received from the paper when transporting the paper, and as a result, it is possible to deform the contact portions 204 and 205 according to the thickness or stiffness of the paper.

Also, the contact portions 203 to 205 are provided at three points, and two of the contact portions 204 and 205 are deformable, so it is possible to disperse the pressing force received from the paper among the contact portions 203 to 205 at three points. Thus, the pressing force applied to the individual contact portions 203 to 205 can be suppressed, so that not only does it become possible to correct curling of a desired paper regardless of the thickness or stiffness of the paper, it is also possible to perform paper transport while maintaining a transport force that is appropriate to the thickness and stiffness of the paper. As a result, the pressing force received from the paper is dispersed by increasing the contact points, so that it becomes possible to transport any paper with a maximum amount of transport force for that paper, and moreover, it becomes possible to suppress the occurrence of creases or other damage in comparison to a configuration with one contact point.

Also, the hollow portion 206 is formed near the contact portions 203 to 205 of the body of the transport roller 201, so the hollow portion 206 can be used as a part that releases the pressing force received when transporting the paper.

Also, the protruding portions 207 with the tips 208 bent is formed, these tips 208 being used as the contact portions 204 and 205, so it is possible to insure that the tip 208 vicinity is a part that releases the pressing force received when transporting the paper.

Also, according to the transport mechanism 122*e* as described above, the five transport rollers 201 are provided to the one shaft 209, and the five transport rollers 201 are capable of correcting curling of an entire sheet of paper transported downstream in the transport path by making contact with the paper.

Also, paper is transported to the nip portion configured from the aforementioned transport rollers 201 and idler rollers 202, and transported downstream in the transport path by the driving rotation of the transport rollers 201 and the idling rotation of the idler rollers 202, so it is possible to transport paper with a nip force appropriate to the thickness and stiffness of the paper. More specifically, for any paper it is possible to transport that paper with a minimum of nip force, and as a result, it is possible to obtain a maximum of paper transport force. Also, because it is possible to transport the paper with a minimum of nip force, it is possible to attain a longer operating life for the transport rollers 201 and the idler rollers 202.

Also, as described above, according to the image forming apparatus 100, the transport mechanism 122*e* is provided in the transport paths S and S' downstream in the transport path from the fixing unit 112, so it is particularly possible to have an effect of correct curling that occurs in paper that has passed through the fixing unit 112. For example, when the transport mechanism 122*e* has been provided in the discharge stage of the transport path S after fixing of developer to the paper, it is possible to improve the stackability of the discharged paper. Also, when the switchback transport path S' is provided in order to allow duplex printing (transfer of developer to both faces of the paper) in the image forming apparatus 100, and the transport mechanism 122*e* has been provided in the switchback transport path S', it is possible to suppress paper transport jams. Further, with the conventional technology, the paper is curled, so there may be cases in which when performing duplex printing, the face on which developer has already been fixed attaches to the intermediate transfer belt 107 (the photosensitive drum 103 in FIG. 4), the transfer roller 113, or the like, but according to this embodiment the paper is not curled, so transfer efficiency and transport efficiency can be improved.

Also, the paper post-processing portion 109, which performs paper post-processing for paper to which developer has been fixed, is added to or provided in the image forming apparatus, and the transport mechanism 122*e* is provided in the paper post-processing portion 109, so it is possible to improve stackability when performing paper post-processing in the paper post-processing portion 109.

The transport roller and the transport mechanism according to the invention are applicable in the body of an image forming apparatus provided with a copy function, print function, facsimile function, or the like, and also applicable in a paper post-processing portion added to an image forming apparatus.

The present invention may be embodied in various other forms without departing from the gist or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. A transport roller provided in a transport path in order to transport paper, the transport roller transporting the paper downstream in the transport path by making contact with the paper; the transport roller comprising:

at least one contact portion that makes contact with the paper, and is deformable in a direction that releases pressing force received from the paper when transporting the paper, wherein a protruding portion with a bent tip is formed, the tip of the protruding portion being the contact portion.

2. The transport roller according to claim 1, wherein contact portions are provided at a plurality of points, and at least one of the contact portions is deformable.

3. The transport roller according to claim 1, wherein a hollow portion is formed near the contact portion in the body of the transport roller.

4. A transport mechanism comprising a plurality of transport rollers according to claim 1 that are provided to one shaft, the plurality of transport rollers transporting paper downstream in a transport path by making contact with the paper.

5. The transport mechanism according to claim 4, comprising the transport rollers, that drivingly rotate, and idler rollers that make contact with the transport rollers and idly rotate due to the driving rotation of the transport rollers, wherein the paper is transported to a nip portion, which is a contact region between the transport rollers and the idler rollers, and transported downstream in the transport path by the driving rotation of the transport rollers and the idling rotation of the idler rollers.

6. The transport mechanism according to claim 4, wherein the amount of deformation of the contact portion differs for each of the plurality of transport rollers for the one shaft, and the amount of deformation of the contact portion is set to become smaller from, of the plurality of transport rollers, a transport roller disposed at an end of the shaft toward a transport roller disposed in the center of the shaft.

7. An image forming apparatus comprising the transport mechanism according to claim 4, the transport mechanism being provided downstream in the transport path from a fixing portion that fixes developer to the paper.

8. The image forming apparatus according to claim 7, comprising a paper post-processing portion that is added to or provided in the image forming apparatus and performs paper post-processing for paper on which developer has been fixed, wherein the transport mechanism is provided in the paper post-processing portion.

9. The image forming apparatus according to claim 7, wherein the transport mechanism is provided furthest downstream in the transport path and inside the body of the image forming apparatus.

10. The image forming apparatus according to claim 7, wherein a plurality of the transport mechanisms are provided in the transport path.

11. The image forming apparatus according to claim 10, wherein in the plurality of transport mechanisms, the amount of deformation of the contact portion is set to become smaller from a transport mechanism disposed upstream in the transport path toward a transport mechanism disposed downstream in the transport path.

* * * * *